US006425658B2

(12) United States Patent
Silverbrook

(10) Patent No.: US 6,425,658 B2
(45) Date of Patent: Jul. 30, 2002

(54) TRANSFORMATION OF MOTION IN A NOZZLE ARRANGEMENT FOR AN INK JET PRINTHEAD

(75) Inventor: Kia Silverbrook, Balmain (AU)

(73) Assignee: Silverbrook Research Ply Ltd, Balmain (AU)

( * ) Notice: Subject to any disclaimer, the term of this patent is extended or adjusted under 35 U.S.C. 154(b) by 0 days.

(21) Appl. No.: 09/864,380

(22) Filed: May 25, 2001

Related U.S. Application Data

(63) Continuation-in-part of application No. 09/112,814, filed on Jul. 10, 1998, now Pat. No. 6,247,791, and a continuation-in-part of application No. 09/112,812, filed on Jul. 10, 1998, now Pat. No. 6,227,654, and a continuation-in-part of application No. 09/113,097, filed on Jul. 10, 1998, now Pat. No. 6,247,795.

(30) Foreign Application Priority Data

Dec. 12, 1997 (AU) ..... PP0893

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

FOREIGN PATENT DOCUMENTS

JP 404001051 A 1/1992

*Primary Examiner*—Raquel Yvette Gordon

(57) ABSTRACT

A nozzle arrangement for an ink jet printhead which is the product of an integrated circuit fabrication technique has a substrate. A fulcrum member is arranged on the substrate. An elongate working member having a load arm and an effort arm is pivotally mounted on the fulcrum to be pivotal with respect to the substrate. An effort mechanism is also arranged on the substrate and is operatively engageable with the effort arm. The effort mechanism is configured to apply an effort to an end of the effort arm.

10 Claims, 2 Drawing Sheets

TRANSFORMATION OF MOTION IN A NOZZLE ARRANGEMENT FOR AN INK JET PRINTHEAD

CROSS REFERENCED AND RELATED APPLICATIONS

This application is a continuation-in-part application of U.S. application Ser. No. 09/112,814 filed Jul. 10, 1998 now U.S. Pat. No. 6,247,791. U.S. application Ser No. 09/112,812 filed Jul. 10, 1998 now U.S. Pat. No. 6,227,654, Ser. No. 09/113,097 filed Jul. 10, 1998 now U.S. Pat. No. 6,427,795, are hereby incorporated by reference.

FIELD OF THE INVENTION

This invention relates to the transformation of motion in a nozzle arrangement for an ink jet printhead. In particular, this invention relates to the use of a lever mechanism to achieve the transformation of motion in such a nozzle arrangement.

BACKGROUND OF THE INVENTION

The Applicant has invented a printhead which is capable of generating text and images at a resolution as high as 1600 dpi. In order to achieve this high resolution, the Applicant has utilized various aspects of micro electromechanical systems technology. The reason for this is that such systems provide a means whereby ink can be ejected independently from a plurality of nozzle arrangements without the use of thermal expansion of ink or other unsatisfactory systems such as those based on piezoelectric movement.

The nozzle arrangements are formed on a page width printhead. In order to achieve the high resolutions, up to 84000 nozzle arrangements can be formed on the page width printhead. Each of these nozzle arrangements is in the form of a micro electromechanical device that incorporates at least one working device which is displaceable to achieve or permit the ejection of ink from each nozzle arrangement.

The Applicant has found that a particular difficulty with such devices is that direct actuation of a working device is limited in the sense that it is often necessary to achieve a degree of movement of a working member that is greater than that that can be achieved through direct actuation. It is also often necessary to transform movement at one position to movement at another position.

Accordingly, the Applicant has conceived this invention to address the disadvantages associated with attempting to transform movement and also the relatively short degree of movement which is presently achieved by actuators in such nozzle arrangements.

SUMMARY OF THE INVENTION

According to a first aspect of the invention, there is provided a nozzle arrangement for an ink jet printhead which is the product of an integrated circuit fabrication technique, the nozzle arrangement comprising a substrate;

a fulcrum member that is arranged on the substrate;

an elongate working member having a load arm and an effort arm, the working member being pivotally mounted on the fulcrum to be pivotal with respect to the substrate; and an effort mechanism that is also arranged on the substrate and that is operatively engageable with the effort arm, the effort mechanism being configured to apply an effort to an end of the effort arm.

According to a second aspect of the invention, there is provided an ink jet printhead which is the product of an integrated circuit fabrication technique, the printhead comprising a substrate, a plurality of nozzle arrangements positioned on the substrate, each nozzle arrangement defining a nozzle chamber from which ink is to be ejected, and comprising a fulcrum member that is arranged on the substrate;

an elongate working member having a load arm and an effort arm, the working member being pivotally mounted on the fulcrum to be pivotal with respect to the substrate;

an ink ejection mechanism that is arranged on the load arm for ejecting ink from the nozzle chamber; and an effort mechanism that is also arranged on the substrate and that is operatively engageable with the effort arm, the effort mechanism being configured to apply an effort to an end of the effort arm.

The invention will now be described, by way of examples only, with reference to the accompanying drawings. The specific nature of the following description should not be construed as limiting in any way the broader scope of the invention described in the above summary.

DETAILED DESCRIPTION OF THE DRAWINGS

Figure 1:
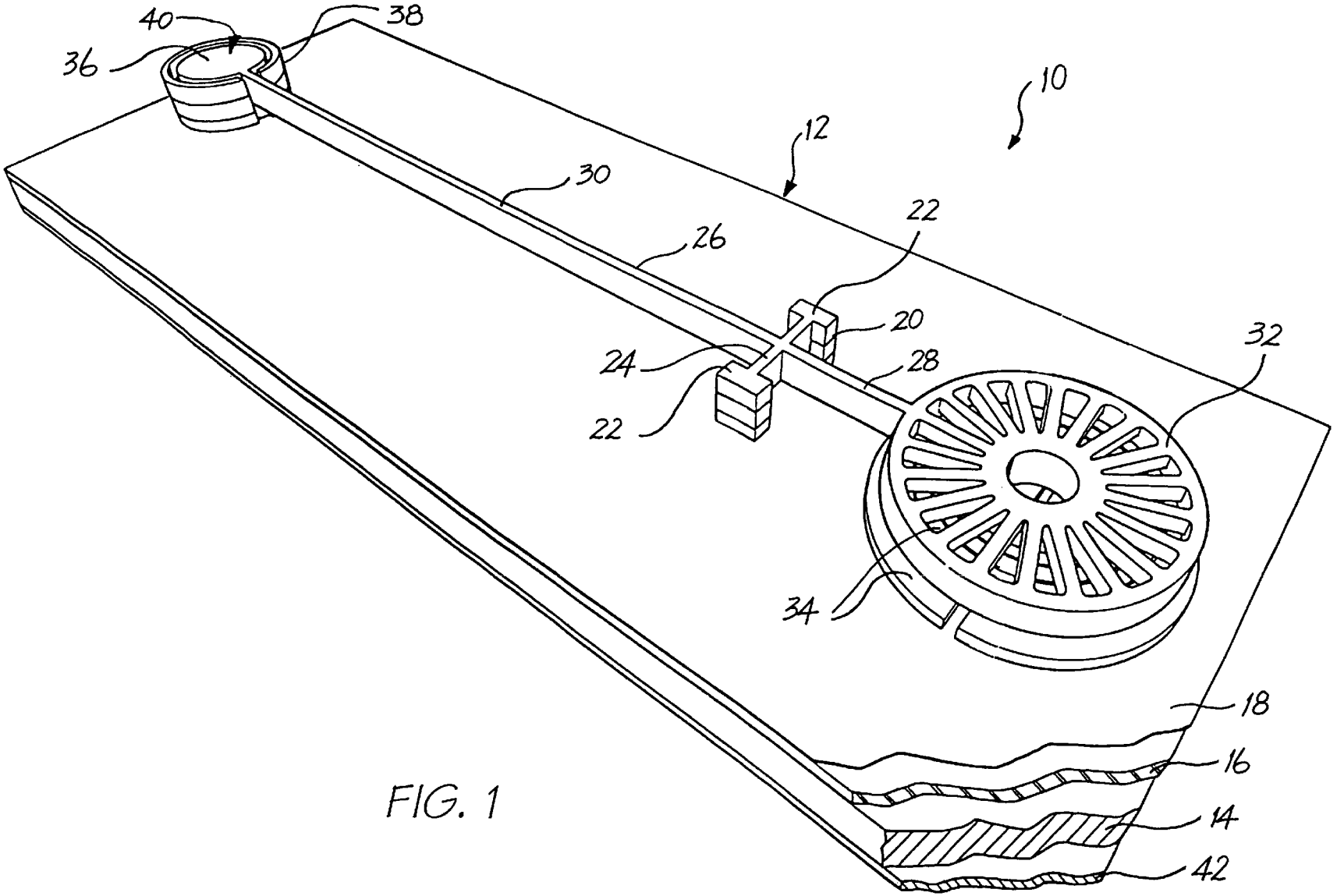
FIG. 1 shows a schematic, three dimensional view of part of an ink jet printhead which incorporates a nozzle arrangement, in accordance with the invention, which is the product of an integrated circuit fabrication technique.

In FIG. 1, reference numeral 10 generally indicates part of a printhead chip showing one of a plurality of nozzle arrangements, indicated at 12, which are each in the form of a micro electromechanical device, in accordance with the invention.

The chip 10 is the result of an integrated circuit fabrication technique. As is known, such techniques involve successive deposition and etching processes. Thus, the printhead chip 10 includes a wafer substrate 14. A drive circuitry layer 16 is formed on the wafer substrate 14. The drive circuitry layer 16 is covered by a suitable passivation layer 18.

The nozzle arrangement 12 includes a fulcrum member 20 that is arranged on the passivation layer 18 to extend from the passivation layer 18. The fulcrum member 20 is layered as a result of the deposition and etching process. Further, the fulcrum member 20 includes a pair of opposed posts 22. A cross member 24 extends between the posts 22.

The manner of manufacture and the materials used for the fulcrum member 20 are set out fully in the above cross-referenced applications. Accordingly, these details will not be set out in this specification.

The cross member 24 is of a material which provides a torsional resilience in a plane of twisting which is substantially normal to a plane of the layers 16, 18.

The nozzle arrangement 12 includes an elongate working member 26 which extends partly across a width of the chip 10 and is fast with the cross member 24. Further, the elongate working member 26 is spaced from the passivation layer 18 to provide a degree of freedom in a pivotal path of movement in a plane also substantially normal to the plane of the printhead chip 10.

Thus, the elongate working member 26 is divided into an effort arm 28 on one side of the fulcrum member 20 and a load arm 30 on the other side of the fulcrum member 20.

A magnetic formation 32 is positioned on an end of the effort arm 28. The magnetic formation 32 is primarily of a magnetic material. For example, the magnetic formation 32 can have a soft iron core covered by a suitable passivation material such as silicon nitride.

The nozzle arrangement 12 includes an effort mechanism in the form of an electromagnet 34 that is positioned on the passivation layer 18 beneath the magnetic formation 32. The electromagnet 34 is connected to the drive circuitry layer 16 in a conventional manner so that the electromagnet 34 can be activated under the control of a control system which acts on the drive circuitry within the layer 16.

It follows that it will be appreciated that, when the electromagnet 34 is activated, the magnetic formation 34 is attracted to the electromagnet 34 resulting in the working member 26 pivoting about the fulcrum member 20.

A working device in the form of an ink displacement paddle 36 is mounted on an end of the load arm 30.

The nozzle arrangement 12 includes a nozzle chamber wall 38 which extends from the passivation layer 18 and defines part of a nozzle chamber 40 which extends through the substrate 14 to be in fluid communication with an ink ejection port (not shown) defined by a further passivation layer 42 arranged on the substrate 14.

It will be appreciated that the use of magnetic fields to achieve displacement of the magnetic formation 32 is limited in the sense that the magnetic formation 32 must be relatively close to the electromagnet 34 in order for the field to act on the electromagnet 34. In this example, the load arm 30 is longer than the effort arm 28 to an extent which transforms the relatively short movement of the magnetic formation 32 into a substantially larger and useful extent of movement of the paddle 36.

The manner in which the nozzle arrangement 12 is constructed and the various materials used for the construction of the nozzle arrangement 12 are set out in detail in the cross-referenced applications. It follows that these details will not be described in this specification.

The cross member 24 is configured so that, when the electromagnet 34 is activated, the working member pivots, against the tension in the cross member 24, to displace the paddle 36 so that ink is drawn into the nozzle chamber 40. When the electro-magnet 34 is de-activated, the paddle 36 is displaced under action of the cross member 24 towards the ink ejection port so that ink is ejected from the ink ejection port.

Figure 2:
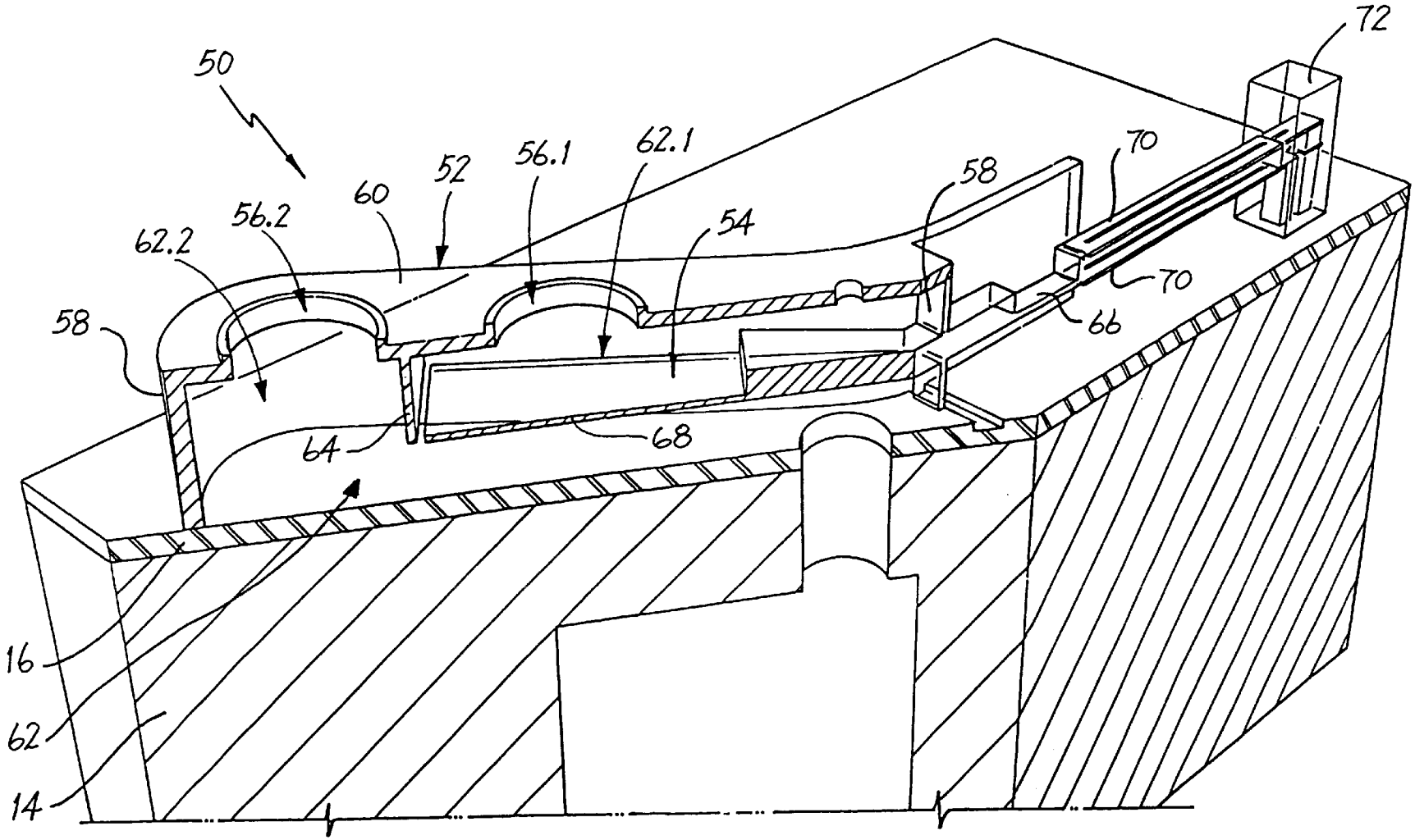
FIG. 2 shows a schematic, partly cross-sectioned view of part of an ink jet printhead, incorporating another embodiment of a nozzle arrangement, also in accordance with the invention, which is the product of an integrated circuit fabrication technique.

In FIG. 2, reference numeral 50 generally indicates a printhead chip which incorporates a nozzle arrangement 52 in the form of a further embodiment of a micro electromechanical device, also in accordance with the invention. With reference to FIG. 1, like reference numerals refer to like parts, unless otherwise specified.

As can be seen in FIG. 2 and as set out in the cross-referenced application no. (IJ37), the nozzle arrangement 52 incorporates an ink displacement member which is required to sweep, in a reciprocal manner, between two extreme positions in order to achieve the ejection of ink through a pair of ink ejection ports 56.

The nozzle arrangement 52 incorporates nozzle walls 58 and a roof wall 60 which define the nozzle chamber 62. The roof wall 60 defines the pair of ink ejection ports 56.

A partitioning wall 64 extends from the roof wall 60 to divide the nozzle chamber 62 into a first part 62.1 and a second part 62.2. One of the ink ejection ports 56.1 is in fluid communication with the first part 62.1 of the nozzle chamber 62 and the other ink ejection port 56.2 is in fluid communication with the second part 62.2 of the nozzle chamber 62.

The ink displacement member 54 is pivotally mounted, at one end, through one of the walls 58.1. The wall 58.1 is resiliently flexible so that the ink displacement member 54 can be displaced between said extreme positions against a tension set up in the nozzle wall 58.1.

An effort arm 66 is mounted on the ink displacement member 54 to extend outwardly from the flexible nozzle wall 58.1. It will therefore be appreciated that the ink displacement member 54 defines a load arm 68. It will thus be appreciated that the flexible wall 58.1, the ink displacement member 54 and the effort arm 66 together define a class one lever. Further, the effort arm 66 is substantially shorter than the ink displacement member 54 so that a relatively short span of movement of an end of the load arm 68 is required to achieve a substantially greater range of movement of an end of the ink displacement member 54. A thermal actuator mechanism 70 is attached to the load arm 68 at one end and is fixed to a support post 72 at the other end. The support post 72 is fixed to the passivation layer 18.

The thermal actuator 70 is in the form of a double acting thermal actuator which is capable of providing reciprocal movement to the effort arm 66.

Those skilled in the field of micro electromechanical systems will appreciate that such thermal actuators can only provide a limited extent of movement since they rely on a coefficient of expansion of a material being heated. It follows that, by having the load arm 68 mounted to the thermal actuator 70, this limited extent of movement can be substantially amplified at an end of the ink displacement member 54. This amplified movement permits the displacement of ink from both the ink ejection ports 56, something which would be difficult to achieve if the thermal actuator 70 was acting directly on the ink displacement member 54.

Applicant believes that the above examples illustrate how a lever mechanism can be used to transform limited motion of an actuator in a nozzle arrangement into useful movement.

I claim:

1. A nozzle arrangement for an ink jet printhead which is the product of an integrated circuit fabrication technique, the nozzle arrangement comprising a substrate;

a fulcrum member that is arranged on the substrate;

an elongate working member having a load arm and an effort arm, the working member being pivotally mounted on the fulcrum member to be pivotal with respect to the substrate; and an effort mechanism that is also arranged on the substrate and that is operatively engageable with the effort arm, the effort mechanism being configured to apply an effort to an end of the effort arm.

2. A nozzle arrangement as claimed in claim 1, in which the substrate includes a wafer substrate and the fulcrum member, working member and effort mechanism are the result of a deposition and etching process carried out on the wafer substrate.

3. A nozzle arrangement as claimed in claim 2, in which the fulcrum member is positioned between the load arm and the effort arm so that the fulcrum member and the working member define a class one lever.

4. A nozzle arrangement as claimed in claim 3, in which the load arm is longer than the effort arm.

5. A nozzle arrangement as claimed in claim 2, in which the effort mechanism is in the form of an magnetic field generator, a magnetic member being arranged on the effort arm so that the magnetic member is attracted to the magnetic field generator when the magnetic field generator is activated, the magnetic field generator being connected to suitable drive circuitry in a drive circuitry layer formed as a result of the deposition and etching process.

6. A nozzle arrangement as claimed in claim 2, in which the effort mechanism is in the form of a thermal bend actuator that comprises an actuator arm that is attached to the substrate to extend from the substrate, the actuator arm being bendable upon the application of a thermal signal, with the effort arm being attached to the actuator arm so that movement generated by the bending of the actuator arm can be converted into movement of the load arm, the thermal bend actuator being connected to suitable drive circuitry in a drive circuitry layer formed as a result of the deposition and etching process.

7. A nozzle arrangement as claimed in claim 1, in which a spring mechanism is arranged on the fulcrum member and the working member so that the working member is biased into a neutral position, and that any pivotal movement of the working member is carried out against a tension of the spring mechanism.

8. A nozzle arrangement as claimed in claim 7, in which the working member is fast with the fulcrum member which, in turn, is fast with the substrate, the fulcrum member being of a resiliently flexible material to define the spring mechanism.

9. An ink jet printhead which incorporates a plurality of micro electro-mechanical devices each as claimed in claim 1.

10. An ink jet printhead which is the product of an integrated circuit fabrication technique, the printhead comprising a substrate, a plurality of nozzle arrangements positioned on the substrate, each nozzle arrangement defining a nozzle chamber from which ink is to be ejected, and comprising a fulcrum member that is arranged on the substrate;

an elongate working member having a load arm and an effort arm, the working member being pivotally mounted on the fulcrum to be pivotal with respect to the substrate;

an ink ejection mechanism that is arranged on the load arm for ejecting ink from the nozzle chamber; and an effort mechanism that is also arranged on the substrate and that is operatively engageable with the effort arm, the effort mechanism being configured to apply an engageable with the effort arm, the effort mechanism being configured to apply an effort to an end of the effort arm.

* * * * *